United States Patent [19]

Mesica et al.

[11] Patent Number: 4,977,757

[45] Date of Patent: Dec. 18, 1990

[54] JEWLERY WITH ROTATABLE ORNAMENTATION

[75] Inventors: Zuri Mesica, Studio City, Calif.; Igal Golan, Tel Aviv, Israel

[73] Assignee: Prestige Collection, Inc., Los Angeles, Calif.

[21] Appl. No.: 477,184

[22] Filed: Feb. 5, 1990

Related U.S. Application Data

[63] Continuation of Ser. No. 401,564, Aug. 28, 1989, abandoned, which is a continuation of Ser. No. 40,890, Apr. 20, 1987, abandoned.

[51] Int. Cl.[5] ..... A44C 9/00

[52] U.S. Cl. ..... 63/15; 63/29.1; 63/31

[58] Field of Search ..... 63/15, 29.1, 26, 31, 63/32, 28; 40/639

[56] References Cited

U.S. PATENT DOCUMENTS

| | | | |
|---|---|---|---|
| 389,778 | 9/1888 | Levy | 40/639 |
| 922,212 | 5/1909 | Tropin | 63/31 |
| 1,672,355 | 6/1928 | Ullman | 40/639 |
| 1,792,534 | 2/1931 | Germain | 63/15 |
| 1,920,875 | 8/1933 | Miskend | 63/15 |
| 2,185,811 | 1/1940 | Heyman | 63/15 |
| 2,585,183 | 2/1952 | Stern | 63/15 |
| 3,504,507 | 4/1970 | Ferro | 63/12 |
| 4,220,017 | 9/1980 | Freeman | 63/15 |

FOREIGN PATENT DOCUMENTS

| | | | |
|---|---|---|---|
| 363137 | 7/1920 | Fed. Rep. of Germany | 63/31 |
| 739455 | 10/1932 | France | 63/31 |
| 1381490 | 11/1964 | France | 63/31 |

*Primary Examiner*—Richard J. Johnson

*Attorney, Agent, or Firm*—Spensley Horn Jubas & Lubitz

[57] ABSTRACT

A ring includes rotatably-mounted and removable ornamental elements. The base of the ring includes a pair of ears for supporting a spindle. The spindle, formed of threadedly cooperative elements is readily disassembled to permit selective removal and reorganization of the ornamental elements.

11 Claims, 1 Drawing Sheet

FIG. 1
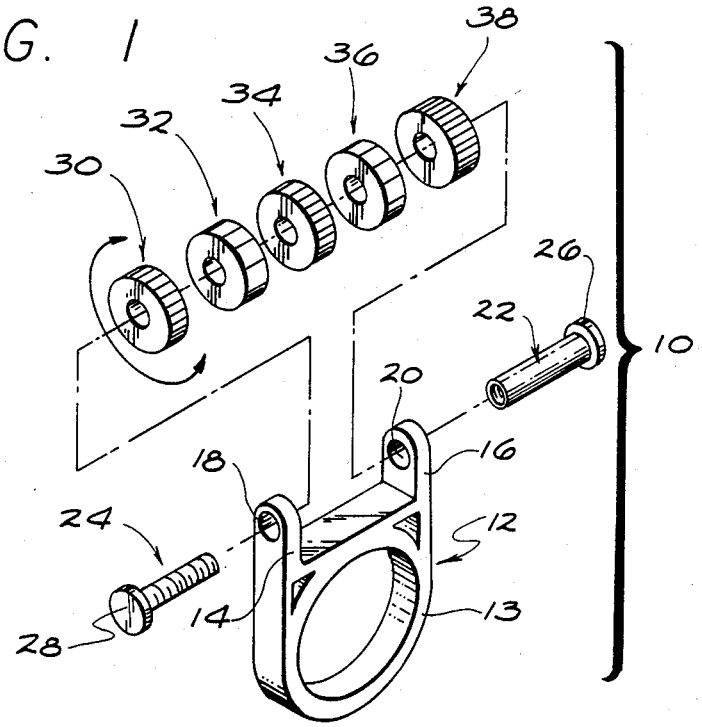
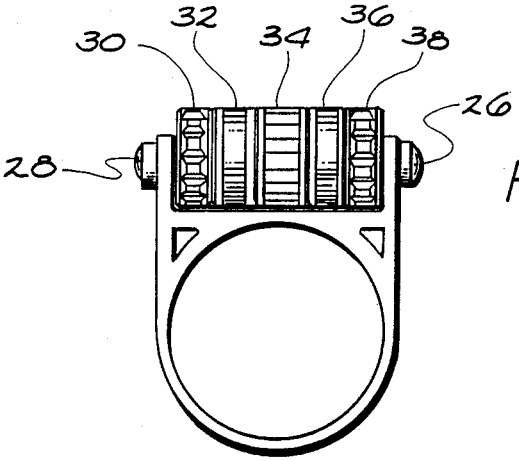
FIG. 2
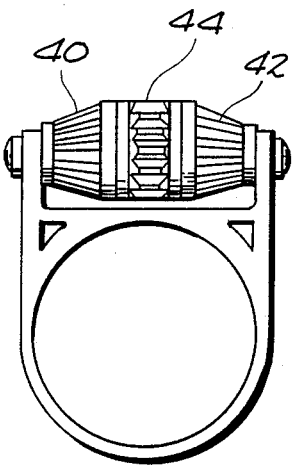
FIG. 3
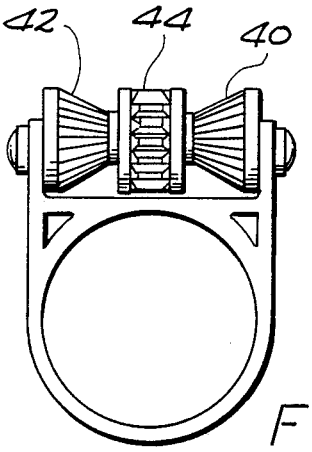
FIG. 4

JEWLERY WITH ROTATABLE ORNAMENTATION

This is a continuation of application Ser. No. 07/401,564 filed Aug. 28, 1989, now abandoned, which is a continuation of Ser. No. 07/040,890 filed Apr. 20, 1987, now abandoned.

BACKGROUND

1. Field of the Invention

The present invention relates to jewelry. More particularly, this invention pertains to jewelry that includes rotatable elements.

2. Description of the Prior Art

Women's jewelry, incuding rings, while often a considerable expense to the buyer, rarely permits "wearer participation". That is, the wearer generally cannot share in the creation of the item. Further, prior art jewelry is usually inert in the sense that ornamental designs rarely, if ever, incorporate mobile elements that might otherwise enhance both the wearer's appearance and enjoyment.

SUMMARY OF THE INVENTION

The present invention overcomes the foregoing and other problems of the prior art by providing a novel ring. Such ring includes a member that is adapted to receive a wearer's finger. An elongated spindle is provided. The aforementioned member includes means for supporting the spindle and at least one ornamental wheel is rotatably mounted to the spindle.

The preceding and other advantages and features of this invention will be more readily apparent from the detailed description that follows. This written description is accompanied by a set of drawing figures. Corresponding numerals of the description and the figures point to the features of the invention, like numerals identifying like features throughout.

BRIEF DESCRIPTION OF THE DRAWINGS

FIG. 1 is an exploded persepective view of a ring in accordance with this invention;

FIG. 2 is a front elevation view of the ring of the preceding figure;

FIG. 3 is a front elevation view of an alternative embodiment of a ring in accordance with the invention; and FIG. 4 is a front elevation view of a second alternative embodiment of a ring in accordance with the invention, such embodiment comprising a distinct arrangement of the elements of the prior illustrated embodiment.

DETAILED DESCRIPTION

Turning now to the drawings, FIG. 1 is an exploded perspective view of a woman's ring 10 in accordance with this invention. The ring 10 comprises an assemblage of elements, both ornamental and functional, that cooperate to provide the wearer with a number of "looks" each of which incorporates a novel "rotation" feature.

The ring 10, preferably of gold or other appropriate precious or jewelry-grade metal such as gold, platinum or titanium, includes a base element 12 adapted to receive the wearer's finger and for rotatably mounting at least one ornamental wheel thereto. The element 12 comprises a generally-circular finger-hold 13 that is appropriately-dimensioned for securing the ring to the wearer's finger. Structure is provided in association with the finger hold 13 for mouting a spindle. Such structure includes a pair of upwardly-projecting ears 14, 16 that are integral therewith. The ears 14, 16 include througholes 18 and 20 respectively for receiving the spindle. In an actual embodiment of the invention the ears 14 and 16 were separated by a distance of 16.7 millimeters, permitting the insertion of an arrangement of ornamental elements of such composite size therebetween.

The spindle of the ring 10 comprises an elongated sleeve 22 having internal threading and adapted to receive a screw 24. The aforementioned elements include head 26 and 28 respectively of enlarged diameter. The heads of the axle elements, in combination with the threaded engagement of the sleeve 22 to the screw 24, serve to secure the axle to the base 12. Gems 25 may be set into the tops of the heads 26 and 28. Thus, the arrangement of the otherwise-functional sleeve 22 and screw 24 additionaly enhances the appearance of the ring 10.

The spindle, when fixed to the base 12 at the througholes 18 and 20 of ears 14 and 16 respectively, rotatably supports a plurality of ornamental wheels 32, 34, 36 and 38. Each of such wheels includes a circular central aperture for rotation about the circumference of the sleeve 22. The ornamental wheels (the diameter of a wheel in accordance with an actual embodiment of the invention is 8 millimeters) may comprises any of a number of attractive designs, and a plurality of such wheels may be chosen and arranged to attain any of a number of desirable and stunning effects.

Individual wheels may have circular, square, trangular or other outer circumferences. Their thicknesses may vary and may include jeweled settings.

FIGS. 2, 3 and 4 are front elevation views of various alternative embodiments of the ring of the invention. The embodiment of FIG. 2 comprises a barrel-like arrangement of the five collar-shaped, jeweled wheels 30, 32, 34, 36 and 38 shown in the exploded perspective view of the prior figure. This is to be contrasted to the arrangements of FIGS. 3 and 4, each of which includes two wheels 40 and 42 of generally conical shape in combination with a central collar-like element 44. The collar-shaped wheels may include a plurality of straight baguette cut diamonds at its periphery while conical wheels can include a plurality of tapered baguette cut gems at its periphery. Other gem cuts may be employed including the so-called square, Prestige and Princess cuts. Thus, as is seen, the ring of the invention permits the wearer to achieve two entirely different appearances by simply unscrewing the spindle components 22 and 24, rearranging the jeweled ornamental wheels and then resecuring the spindle to the ears 14 and 16 of the base 12. Further, the ring 10 can be seen to be readily adapted to different appearances through the simple expedient of substituting variously-shaped wheels. Numerous ornamental wheel designs of compatible design (i.e. having an appropriately-sized central aperture) may, of course, be rotatble "set" within the ring 10.

Thus it is seen that the present invention provides a novel arrangement for a ring that permits the wearer to effectively design and redesign its ornamental appearance. Each design includes at least one element that is rotatable about a spindle, a feature that is not found in the prior art and which provides a unique experience for a wearer.

While the invention has been described with reference to a number of presently preferred embodiments, it is not limited thereto. Rather, the scope of the invention is only limited insofar as defined by the following set of patent claims and includes all equivalents thereof.

What is claimed is:

1. A ring comprising, in combination:
(a) a member adapted to receive the finger of a wearer;
(b) an elongated spindle transversely supported by said member;
(c) a plurality of separable ornamental wheels freely rotatably carried by said spindle; and
(d) fastener means for releasably securing the spindle to the member so that the wearer may readily release the spindle from the member in order selectably to substitute a different ornamental wheel or to rearrange the order of existing ornamental wheels, and then resecure the spindle to the member.

2. A ring as defined in claim 1 wherein said member further includes:
(a) a generally circular portion for accepting the wearer's finger; and
(b) a pair of ears adapted to support the spindle.

3. A ring comprising, in combination:
(a) a member adapted to receive the finger of a wearer, said member having a generally circular portion for accepting the wearer's finger and a pair of ears adapted to support the spindle;
(b) an elongated spindle transversely supported by said member, said spindle having an internally-threaded sleeve and a screw adapted to engage said sleeve; and
(c) a plurality of separable ornamental wheels rotatably carried by said spindle.

4. A ring as defined in claim 3 further characterized in that:
(a) said sleeve and said screw each includes an enlarged diameter head; and
(b) at least one gem is set at each of said heads.

5. A ring as defined in claim 4 wherein said at least one ornamental wheel is generally collar-shaped.

6. A ring comprising, in combination:
(a) a member adapted to receive the finger of a wearer, said member including a generally circular portion for accepting the wearer's finger;
(b) an elongated spindle which includes an internally-threaded sleeve and a screw adapted to engage said sleeve; wherein said sleeve and said screw each includes an enlarged diameter head, and at least one gem is set at each of said heads;
(c) said member including means for transversely supporting said spindle, said means including a pair of ears; and
(d) a plurality of ornamental wheels rotatably mounted to said spindle wherein at least one ornamental wheel is generally collar-shaped and at least one ornamental wheel is of generally-conical shape.

7. A ring comprising, in combination:
(a) a unitary substantially rigid member having a continuous circular opening adapted to receive the finger of a wearer;
(b) an elongated spindle transversely supported by said member;
(c) at least one ornamental wheel freely rotatably carried by said spindle; and
(d) fastener means for releasably securing the spindle to the member, wherein the wearer may readily release the spindle from the member in order to substitute a different ornamental wheel and resecure the spindle to the member.

8. A ring as defined in claim 7 wherein said at least one ornamental wheel is generally collar-shaped.

9. A ring as defined in claim 7 further including at least one ornamental wheel of generally-conical shape.

10. A ring comprising, in combination:
(a) a member adapted to receive the finger of a wearer; said member defining a pair of aligned apertures adapted to receive the spindle;
(b) an elongated spindle releasably secured to said member, said spindle including an internally-threaded sleeve adapted to pass through a member aperture and a screw adapted to pass through a member aperture to engage said sleeve and secure the spindle to the member; and
(c) at least one ornamental wheel rotatably carried by said spindle,
wherein the wearer may readily release the spindle from the member in order to substitute a different ornamental wheel and resecure the spindle to the member.

11. A ring as defined in claim 10 further characterized in that:
(a) said sleeve and said screw each includes an enlarged diameter head; and
(b) at least one gem is set at each of said heads.

* * * * *